United States Patent [19]

Paschen

[11] Patent Number: 4,835,539

[45] Date of Patent: May 30, 1989

[54] BROADBANDED MICROSTRIP ANTENNA HAVING SERIES-BROADBANDING CAPACITANCE INTEGRAL WITH FEEDLINE CONNECTION

[75] Inventor: Dean A. Paschen, Lafayette, Colo.

[73] Assignee: Ball Corporation, Muncie, Ind.

[21] Appl. No.: 864,854

[22] Filed: May 20, 1986

[51] Int. Cl.[4] ..... H01Q 1/38

[52] U.S. Cl. ..... 343/700 MS; 343/822

[58] Field of Search ..... 343/700 MS, 822, 829, 343/830

[56] References Cited

U.S. PATENT DOCUMENTS

| | | | |
|---|---|---|---|
| 4,320,401 | 3/1982 | Schiavone | 343/700 MS |
| 4,386,357 | 5/1983 | Patton | 343/700 MS |
| 4,475,108 | 10/1984 | Moser | 343/700 MS |
| 4,531,130 | 7/1985 | Powers | 343/700 MS |

FOREIGN PATENT DOCUMENTS

| | | | |
|---|---|---|---|
| 0105103 | 4/1984 | European Pat. Off. . | |
| 0188087 | 7/1986 | European Pat. Off. . | |
| 54-75639 | 6/1979 | Japan . | |
| 2166907 | 3/1985 | United Kingdom | 343/700 MS |

OTHER PUBLICATIONS

Fong et al, "Wideband Multilayer Coaxial-Fed Microstrip Antenna Element", 21 *Electronic Letters* No. 11, pp. 497–499 (1985).

Griffin, J. M. and Forrest, J. R., 'Broadband Circular Disc Microstrip Antenna', Electron. Letters, 1982, 18, pp. 266–269.

*Primary Examiner*—William L. Sikes

*Assistant Examiner*—Doris J. Johnson

*Attorney, Agent, or Firm*—Gilbert E. Alberding

[57] ABSTRACT

The feedline connection to a microstrip antenna patch is designed to integrally include a predetermined capacitance for broadbanded operation. RLC parameters of a parallel circuit model for a specific radiator for a given feedpoint location are measured or otherwise determined. A series LC feed network is then employed and predetermined series LC parameters are chosen so as to optimize the desired bandwidth for the resulting two-stage band pass filter network. The resulting broadbanded microstrip antenna system, network may provide an operating bandwidth on the order of 30% (with less than 2:1 VSWR).

18 Claims, 6 Drawing Sheets

MICROSTRIP PATCH
(PRIOR ART)

BANDPASS FILTER
(PRIOR ART)

MAXIMUM INSERTION
LOSS VERSUS DECREMENT
(PRIOR ART)

TYPICAL INPUT IMPEDANCE
OF THICK PATCH
(PRIOR ART)

ELEMENT VALUES
VERSUS δ FOR N=2
(PRIOR ART)

PATCH IMPEDANCE WITHOUT PROBE INDUCTANCE (PRIOR ART)

INPUT IMPEDANCE OF BROADBANDED PATCH (PRIOR ART)

DIRECT FED PATCH (PRIOR ART)

INCREASED INDUCTANCE (PRIOR ART)

PARALLEL—PLATE

PARALLEL-PLATE

CYLINDRICAL

CYLINDRICAL (GAS ELEMENT INPUT IMPEDANCE)

(LINEAR RADIATION PATTERN AT 1227MHz)

LINEAR RADIATION PATTERN AT 1381 MHz

LINEAR RADIATION PATTERN AT 1575 MHz

BROADBANDED MICROSTRIP ANTENNA HAVING SERIES-BROADBANDING CAPACITANCE INTEGRAL WITH FEEDLINE CONNECTION

This invention generally relates to microstrip antennas (including RF feeds thereto) and to techniques for broadening and optimizing their operational bandwidth.

Microstrip antenna systems of many types are now well-known in the art. In very brief summary, microstrip antenna radiators comprise resonantly dimensioned conductive surfaces disposed less than about one-tenth wavelength above a more extensive underlying conductive ground plane. The radiator elements may be spaced above the ground plane by an intermediate dielectric layer or by suitable mechanical standoff posts or the like. In some forms (especially at higher frequencies), the microstrip radiators and interconnecting microstrip RF feedline structures are formed by photochemical etching techniques (like those used to form printed circuits) on one side of a doubly clad dielectric sheet with the other side providing at least part of the underlying ground plane or conductive reference surface.

Microstrip radiators of many types have become quite popular due to several desirable electrical and/or mechanical characteristics. However, microstrip radiators naturally tend to be relatively narrow bandwidth devices (e.g. on the order of 2–5% or so) and this natural characteristic sometimes presents a considerable disadvantage and disincentive to the use of microstrip antenna systems.

For example, there is extensive demand for antennas in the L-band frequency range which cover both of the global positioning satellite (GPS) frequencies L1 (1575 MHz) and L2 (1227 MHz). It may also be desirable to include the L3 frequency (1381 MHz) so as to permit the system to be used in either a global antenna system (GAS) or in G/AIT IONDS programs. As may be appreciated. if a single antenna system is to cover both bands L1 and L2, the required bandwidth is on the order of at least 25% (e.g., $\delta F$ divided by the midpoint frequency). Although microstrip radiating elements have many characteristics that might make them attractive for use in such a medium bandwidth situation, available operating bandwidths for a given microstrip antenna radiator have typically been much less than 25%—even when "broadbanded" by use of many prior art techniques. Even when adequate prior broadbanding techniques are employed, there may be no known optimum way to achieve the requisite capacitance in the feedline structure in the most advantageous way.

Some nonexhaustive examples of prior techniques for achieving a broadened bandwidth microstrip antenna structure can be illustrated by the following prior issued United States patents:

U.S. Pat. No. 3,971,032—Munson et al (1976)
U.S. Pat. No. 4.160,976—Conroy (1979)
U.S. Pat. No. 4,259,670—Schiavone (1981)
U.S. Pat. No. 4,320,401—Schiavone (1982)
U.S. Pat. No. 4,445,122—Pues (1984)
U.S. Pat. No. 4,529,987—Bhartia et al (1985)

As explained in these prior art references the typical 2–5% natural bandwidth of a microstrip radiator can be increased somewhat merely by detuning the radiator element with additional tabs or the like, by providing additional radiators at different frequencies in a common feed network, or by providing special impedance matching circuits associated with a feedline structure. Relatively complex and space consuming solutions (such as Schiavone teaches) may be able to obtain truly broadbanded operation while others are happy to achieve on the order of only 10% bandwidth using somewhat simpler structures. Bhartia et al claim to have achieved bandwidths on the order of 30% by using active controlled elements such as Varactor diodes between the edges of the radiator element and the underlying ground plane. Most of these prior attempts to achieve broadbanded operation appear to use direct conductive feedline connections to the microstrip radiator patch. However, at least one other prior art reference does disclosure the use of a series capacitance in the feedline for achieving broadbanded operation:

Griffin, J. M., and Forest, J. R., "Broadband Circular Disk Microstrip Antenna," IEE Electronics Letters 18, 266–269 (1982).

Griffin et al is particularly relevant in that they teach a 35% bandwidth over which VSWR is less than 1.5. This is achieved by considering the radiator to be a parallel RLC circuit and the feedline a series inductance. To the series feedline inductance, a series capacitance is added so as to series-resonate at the same frequency as the parallel resonant circuit model.

It appears that Griffin et al used a simple conventional lumped capacitor in the feedline although they state: "simple capacitive breaks in a feedline may be used to realize the series capacitance, but other techniques are also under investigation," (It is believed that the present invention offers a particularly advantageous technique for achieving such requisite series capacitance.)

Others have also used various types of nonconductively coupled feedline systems for achieving other desired purposes. For example, a nonexhaustive listing of prior issued U.S. patents teaching nonconductively coupled RF microstrip radiators/feedlines:

U.S. Pat. No. 3,811,128—Munson (1974)
U.S. Pat. No. 4,070,676—Sanford (1978)
U.S. Pat. No. 4,477,813—Weiss (1984)

Still other examples of nonconductive coupling to RF radiator structures can be found in:

U.S. Pat. No. 3,016,536—Fubini (1962)
U.S. Pat. No. 3,573,831—Forbes (1971)
U.S. Pat. No. 3,757,342—Jasik et al (1973)
U.S. Pat. No. 3,978,487—Kaloi (1976)
U.S. Pat. No. 4,054,874—Oltman, Jr. (1977)

I have now discovered that such series coupling capacitance in the feedline (together with the series inductance of the feedline) can be conveniently incorporated as an integral part of the necessary feedline structure (for a relatively "thick" type of microstrip radiator structure where the feedline extends vertically upward from below the patch) thus minimizing any required extra space and/or manufacturing concerns.

The broadbanding design technique of this invention is based upon use of a parallel RLC model for the microstrip radiator patch itself and a series LC model for the transmission line structure which feeds the radiator. The location of the feedpoint on the microstrip radiator determines the parallel R parameter value (which is typically and conventionally chosen so as to achieve a matched transmission line impedance at the mid-band operating frequency). Once this point is selected, the parallel RLC values of the model parameters can be empirically measured or otherwise determined (e.g., it also may be possible to derive suitable mathematical formulae for calculating the parallel RLC parameter values of the model for a given antenna geometry).

Once the parallel RLC parameter values for the microstrip radiator of interest have been determined. then conventional filter design techniques are utilized for determining optimum series LC values for the feedline so as to achieve optimized VSWR over the desired bandwidth. In a simplified first approximation, the series LC circuit may be thought of as approximately tuned to series resonance at the mid-band frequency (where the parallel RLC model is also resonant).

Once the optimum series LC parameter values have been thus determined, the feedline structure is dimensioned and designed so as to inherently produce these desired parameter values. Typically, the necessary inductance may be obtained by a suitably narrowed (or widened) section of the transmission line structure itself. The necessary series capacitance can be achieved by building the requisite series capacitance into the transmission line (e.g., by suitably dimensioned and juxtapositioned conductive elements separated by dielectric or the like).

In the exemplary embodiment, each microstrip radiator is an approximately circular disk about one-half wavelength in diameter shorted to the underlying ground or reference surface at its center point (thus creating a shorted annular quarter-wavelength resonant cavity under the raised radiator surface). It is then fed at two locations spatially separated by 90° with electrical RF signals which are electrically phased with respect to one another by 90° so as to result in an approximately circular polarization characteristic, all of which is by now well-known in the art. In the exemplary embodiment, the ground or reference surface approximately conforms to a hemisphere with a plurality of such circular radiators (each of which actually is also conformed to a small circular section of a concentric spherical surface) arranged thereon. By switch selecting only one (or some) of the radiators distributed over the hemispherical reference surface. the pointing angle of the active antenna radiator(s) may be adjusted as desired throughout a hemispheric volume.

In this exemplary embodiment, the RF feed comprises a conductive post which extends upwardly from a feedpoint. The feedpoint may emanate directly from an RF connector or may emanate from a suitable intermediate microstrip transmission line, hybrid coupler or the like located near the ground or reference surface on a "printed circuit" type of structure. In any event, in this exemplary embodiment, the necessary series inductance is provided by a first section of such a coupling post. A second distal section of the coupling post is dimensioned to cooperate with a dielectric sleeve and conductive collar (which is, in turn, conductively connected to the microstrip radiator itself) so as to provide the requisite amount of series capacitance. The same type of series LC feedpost is utilized for each feedpoint connection on these circularly polarized radiators.

The result is a broadbanded microstrip antenna system network which includes a microstrip antenna RF radiator element represented by a model lumped parameter circuit having characteristic parallel-connected resistance (R1) inductance (L1) and capacitance (C1). The RF feedline connected thereto is similarly represented by a model lumped parameter circuit which includes a predetermined series-connected inductance (L2) and capacitance (C2) so as to feed RF electrical signals to/from the radiator element at a point which determines the value of R1 and with the L2 and C2 values being predetermined so as to optimize the usable bandwidth of the network between predetermined frequencies $w_1$ and $w_2$. As previously mentioned, the series L2, C2 values and the parallel L1. C1 values are both approximately resonant at a frequency near the middle of the usable bandwidth. Such a broadbanded system network may produce a 2:1 VSWR bandwidth in excess of 20% and even in excess of 30%. In particular, this technique may be used to produce a usable bandwidth which encompasses frequencies L2 (1227 MHz) through L1 (1575 MHz) using a single form of microstrip radiator (e.g., adapted for circular or elliptical polarization).

These as well as other objects and advantages of this invention will be more completely understood and appreciated by carefully reading the following detailed description of a presently preferred exemplary embodiment when taken in conjunction with the accompanying drawings, of which:

Figure 11A:
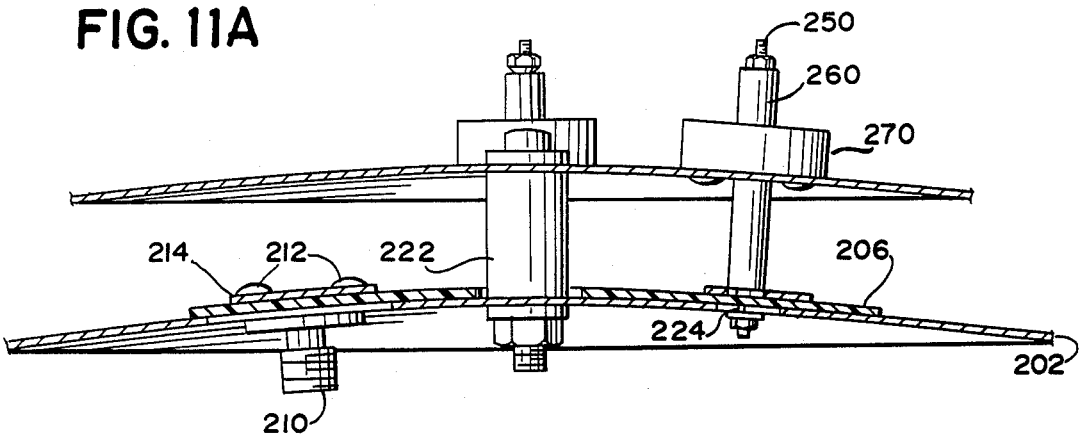
Figure 11B:
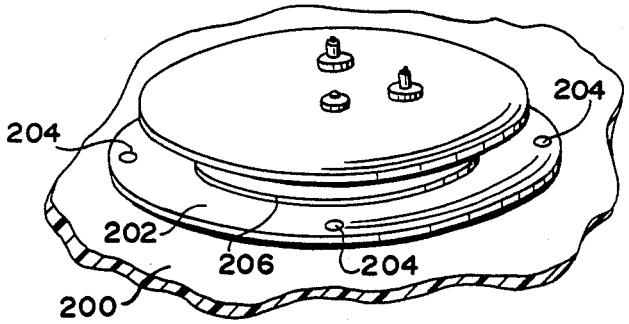
Figure 12:
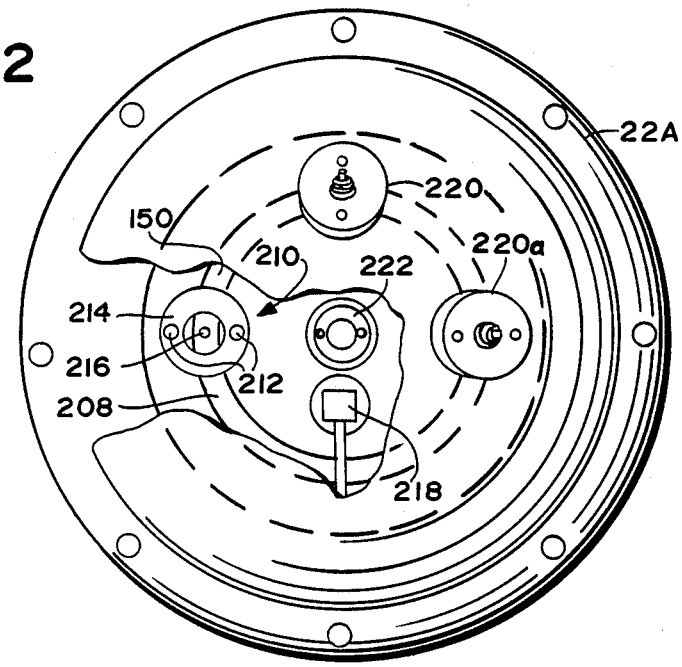
Figure 11C:
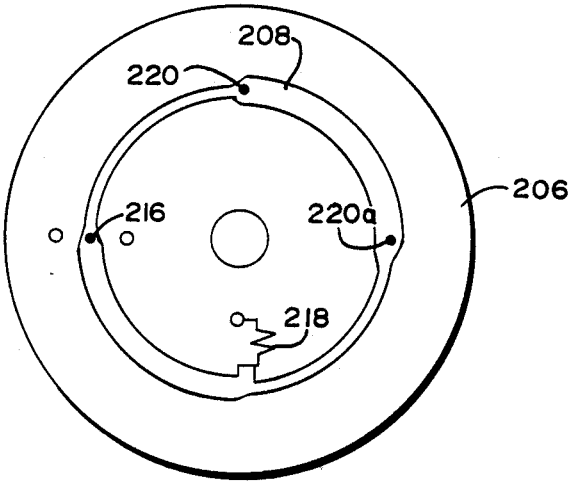
Figure 11D:
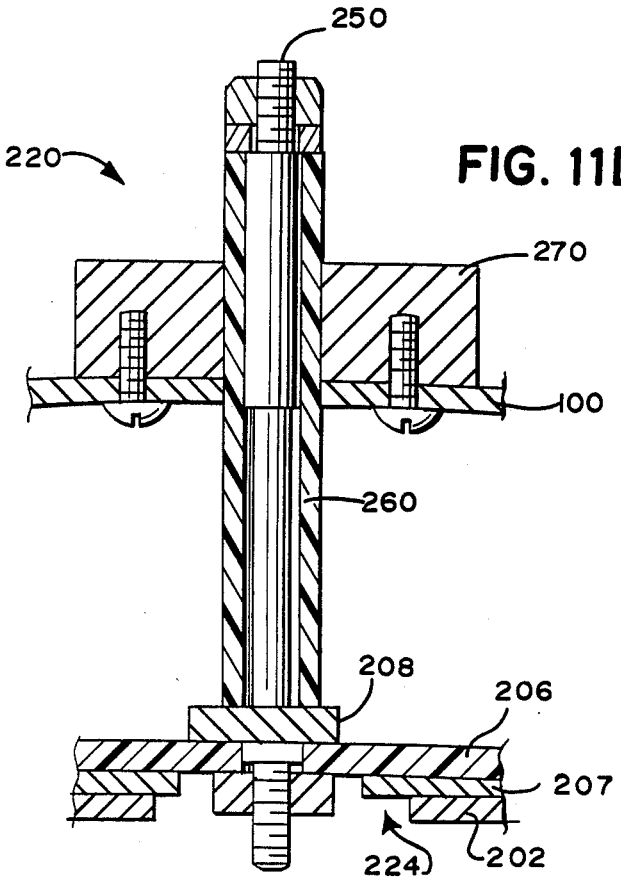

FIGS. 10*a*–10*d* are schematic depictions of four techniques for achieving integral series capacitance in the RF feedline structure:

FIGS. 11*a* and 11*b* are a cross-section and a prospective view respectively of an exemplary embodiment;

FIG. 11*c* is a more detailed view of the printed circuit hybrid coupler phase shifting circuit used in the exemplary embodiment:

FIG. 11*d* is a cross-sectional view of the series LC feedpost structure used in the exemplary embodiment;

FIG. 12 is partially cut-away plan view of the embodiment shown in FIGS. 11*a*–11*b;*

Figure 13:
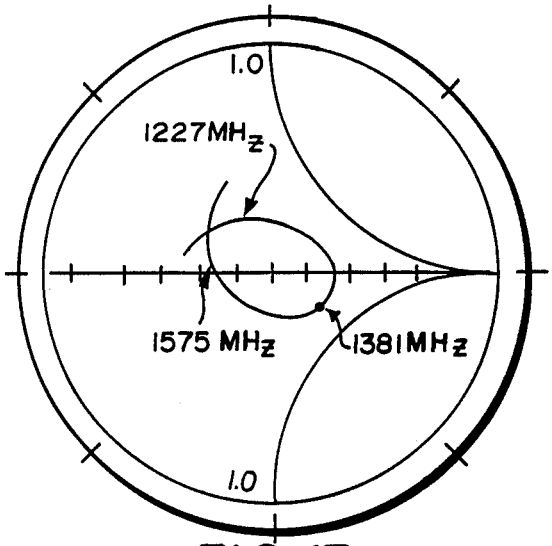
Figure 14:
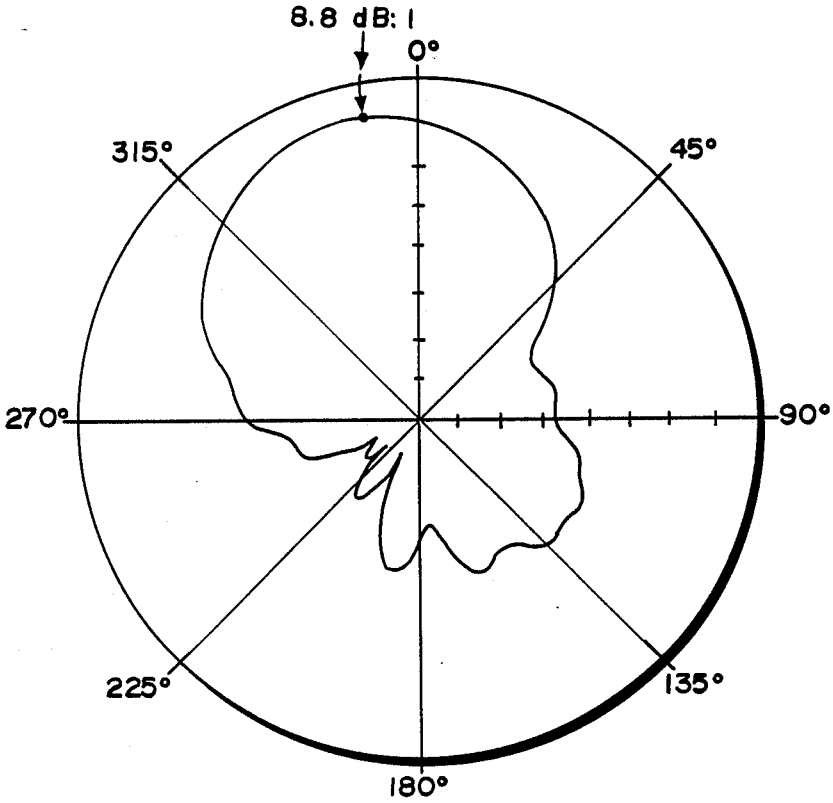
Figure 15:
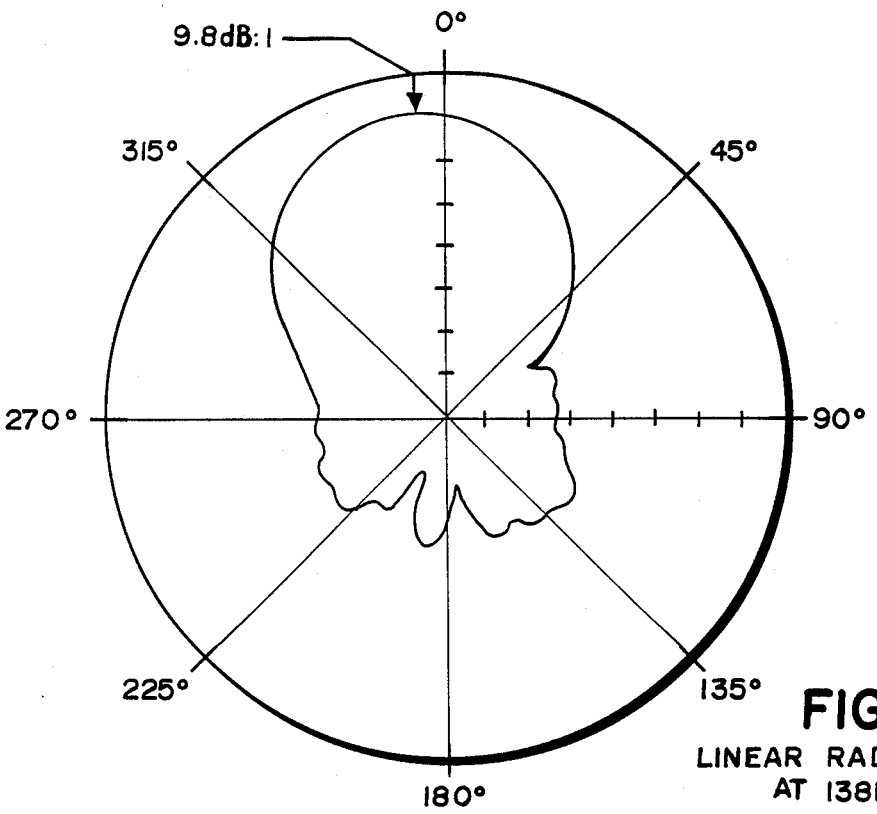
Figure 16:
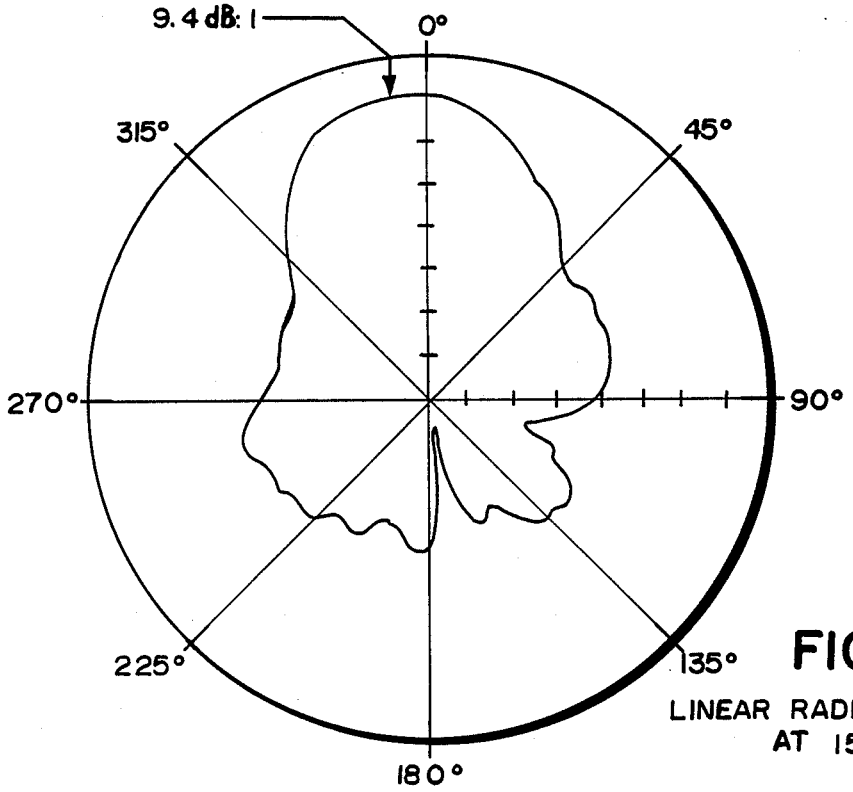

FIG. 13 is a Smith Chart plot of the actual resulting input impedance for the exemplary embodiment: and FIGS. 14–16 are plots of the linear radiation pattern for the exemplary embodiment at frequencies of 1227 MHz, 1381 MHz and 1575 MHz. respectively.

Figure 1:
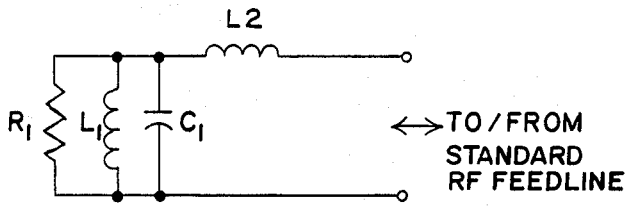
FIG. 1 is an electrical circuit diagram of a lumped-parameter model circuit of attypical microstrip radaitor patch and its accompanying feedline.

I have assumed a parallel RLC model for a microstrip radiator patch as depicted in FIG. 1. Here, it is assumed that (for a given choice of feedpoint location on the patch), there is a fixed R1. L1 and C1 characteristic of the particular patch. As will be appreciated this means that the Q of the patch is assumed to remain fixed. In addition, the model of FIG. 1 assumes a series inductance L2 for the feedline structure connecting the radiator itself to a standard RF transmission structure where RF signals are fed to/from the element and an RF circuit located at the other end of such a transmission line.

Figure 2:
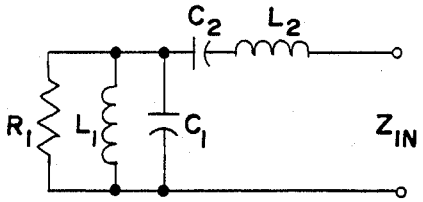
FIG. 2 is similar to FIG. 1 but including a series connected capacitance C2 in the feedline.

When a microstrip radiator/feed circuit is modeled as depicted at FIG. 1, it can be seen that it closely resembles the circuit diagram for a conventional two-stage bandpass filter as shown in FIG. 2. In other words, it may now be appreciated that the addition of a series capacitance C2 (to resonate the parasitic inductance L2) can be utilized to enhance the performance of the microstrip element. Furthermore, since the series LC parameter values can (in accordance with this invention) be independently designed into the feedline structure itself, then the L2, C2 values can be dimensioned in a predetermined way so as to provide maximum bandwidth for the two-stage bandpass filter network of FIG. 2 (again under the assumption that the Q of the parallel tank circuit R1, L1, and C1 remains fixed).

The first step of the optimizing technique requires one to determine parallel RLC model parameter values for the microstrip radiator patch. There are, perhaps, several techniques for making this determination. However, in the exemplary embodiment, the desired microstrip radiator element was actually built and its input impedance was measured using standard laboratory equipment. By varying the RF input frequency, the point of maximum resistance was derived and this directly provides the R1 value of the model circuit shown in FIGS. 1 and 2. Since this point of maximum resistance is also known to occur at the resonant frequency of the parallel L1 and C1 circuit. The value of series inductance L2 (in the non-optimized circuit of FIG. 1) can also be directly determined as the reactive part of the measured input impedance at the parallel resonant frequency (e.g., the point of maximum resistance). The point P1 shown on the Smith Chart plot of FIG. 3 may thus be directly measured using standard laboratory procedures and the values of R1 and L2 may be directly determined from such measurement as should now be appreciated.

As previously noted, the impedance at point P1 ($Z_{P1}$) is at resonance and therefore $$Z_{P1}=R1+jw_oL2 \quad \text{(Equation 1)}$$

In addition, C1 and L1 are known to be related at the resonant frequency $w_o$ by the formula:

$$w_o^2=1/(L1.C1) \quad \text{(Equation 2)}$$

Using standard circuit network analysis techniques, an explicit formula for the measured input impedance $Z_{in}$ can be derived as:

$$Z_{in}=f(w, R1, L2, L1, C1) \quad \text{(Equation No 3)}$$

Since there are only two remaining unknown parameter values (L1 and C1). the input impedance $Z_{in}$ can be measured at two known discrete frequencies so as to provide two equations in two unknowns which can be conventionally solved for the values of L1 and C1. (Alternatively, as shown below, the values for L1, C1 and even R1 can be determined "automatically" as part of the process of finding optimal values for L2 and C2.)

The second step of the exemplary procedure uses conventional filter synthesis techniques so as to determine optimal values for L2 and C2 in the two-stage band pass filter network model of FIG. 2. At the same time, one may also determine whether the chosen microstrip radiator feedpoint (which determines R1) is optimal. If not, the feedpoint location can be changes so as to achieve the desired R1 and the first step repeated so as to determine the R1, C1 and L1 parameter values for the model circuit.

Figure 4:
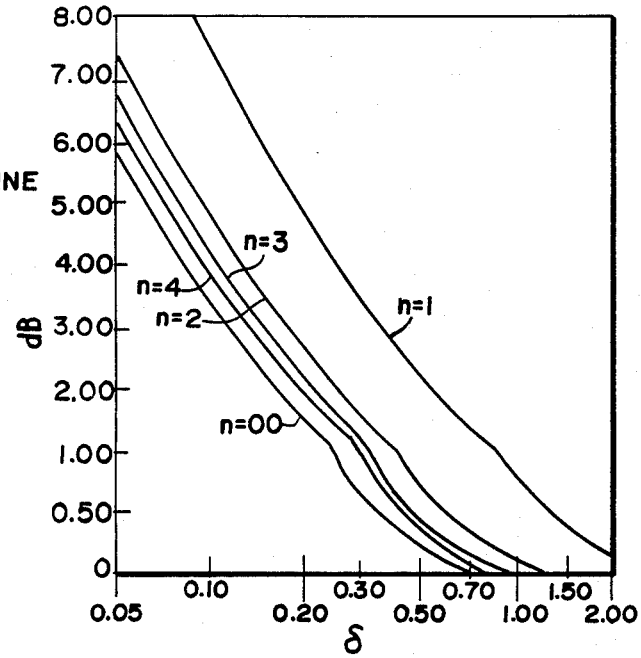
FIGS. 4 and 5 are standard textbook curves used for optimizing the bandwidth of a two-stage bandpass filter of the form shown in FIG. 2.
Figure 5:
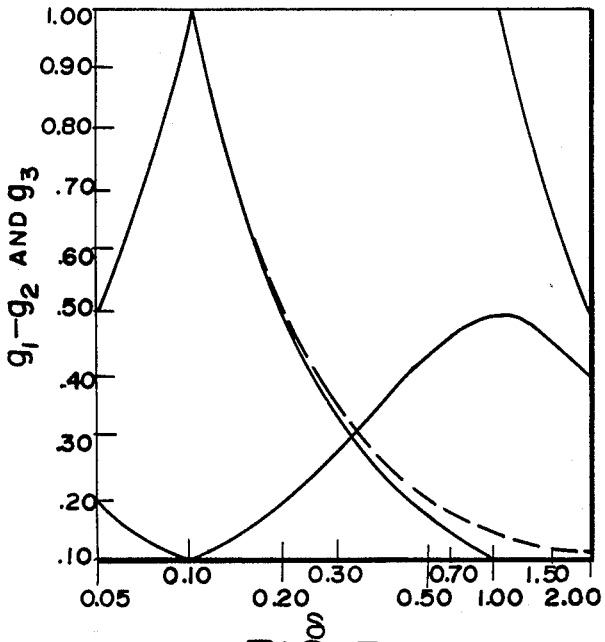

The curves shown in FIGS. 4 and 5 are conventional bandpass filter optimization design aids well-known to those in the art (e.g., see Matthaei et al "Microwave Filters, Impedance-Matching Networks, and Coupling Structures," McGraw-Hill, New York, pp 123–129 (1964)). Here, if one chooses as a design requirement a 1.8:1 maximum for input VSWR (a 0.35 dB loss), then a decrement δ for an N=2 stage network is seen to be approximately 0.65. Then using the FIG. 5 plots for N=2 stage networks, the design parameters $g_1$, $g_2$ and $g_3$ values are determined to be approximately:

$$g_1=1.50 \quad \text{(Equation No. 4)}$$

$$g_2=0.455 \quad \text{(Equation No. 5)}$$

$$g_3=1.85 \quad \text{(Equation No. 6)}$$

The following standard filter optimization equations may then be utilized:

$$C1=\frac{g_1}{R1(w_2-w_1)} \quad \text{(Equation No. 7)}$$

$$L1=\frac{1}{w_o^2\,C1} \quad \text{(Equation No. 8)}$$

$$L2=\frac{g_2\,R1}{w_2-w_1} \quad \text{(Equation No. 9)}$$

$$C2=\frac{1}{w_o^2\,L2} \quad \text{(Equation No. 10)}$$

$$R_{in}=R1/g_3 \quad \text{(Equation 11)}$$

Figure 3:
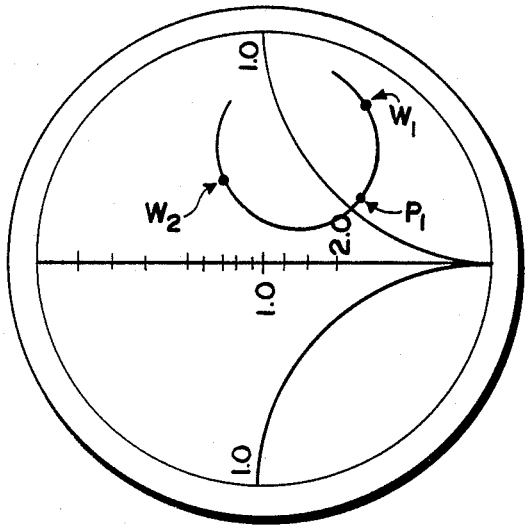
FIG. 3 is a Smith Chart plot of typical input impedance for a relatively thick microstrip radiator patch (of the type employed in the exemplary embodiment) illustrating the point Pi which occurs at resonance where the patch exhibits maximum resistivity.

In the exemplary embodiment, a standard 50 ohm transmission line feed is assumed. Therefore, for a matched input impedance, R1 should equal approximately 50 $g_3$ or approximately 92.5 ohms. As can be seen in FIG. 3, R1 for the exemplary embodiment is already approximately 92.5 ohms and thus the proper feedpoint location on the microstrip radiator patch itself has been properly chosen. If this were not the case, then a different feedpoint location would be chosen (movement towards an open edge of the patch would increase the resistance while movement in the other direction would result in a lower resistance) until the desired R1 value is achieved for a match with the assumed main RF transmission line impedance.

Figure 6:
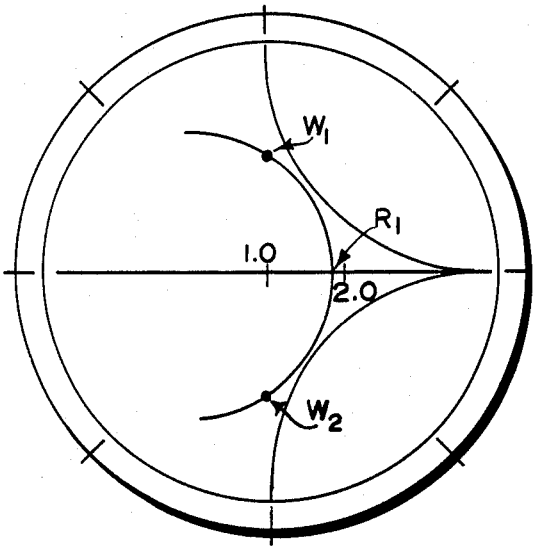
FIG. 6 is a Smith Chart plot of the microstrip radiator patch input impedance where feedline inductance effects have been deleted.

Subtraction of the series inductive reactance wL2 from each input impedance point results in the Smith Chart plot of FIG. 6. In other words, this is the expected ideal Smith Chart plot for the parallel tank circuit. Using the design criteria determination that the decrement δ should be equal to 0.65 and the knowledge that the known equation for δ at the band edges where $w=w_1$ or $w_2$:

$$\delta=\frac{Re[Y_{in}]}{Im[Y_{in}]} \quad \text{(Equation No. 12)}$$

-continued $$w = w_1 \text{ or } w_2$$

Figure 7:
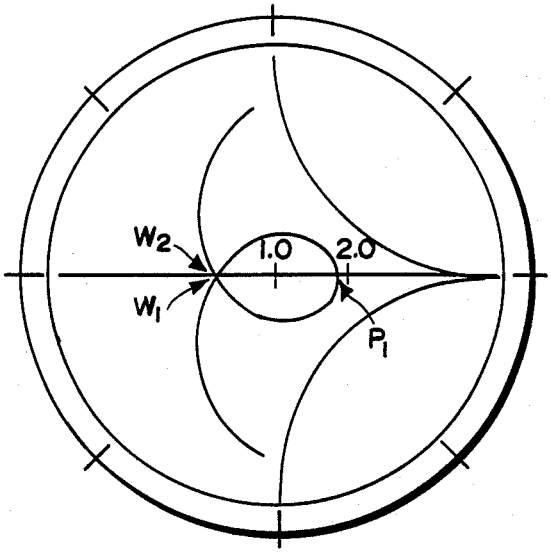
FIG. 7 is a Smith Chart plot of expected broadband patch input impedance when the feedline series LC values have been optimized in accordance with this invention.

Therefore, using a Smith Chart plot such as that shown in FIG. 6 for the parallel tank circuit, the frequencies $w_1$ and $w_2$ can be determined as depicted in the Smith Chart of FIG. 6. Once the band edges $w_1$ and $w_2$ are determined, the foregoing equations can also be used to find model values for L1 and C1 as well as the optimized component values for L2 and C2. The expected input impedance for such a broadbanded patch (e.g., with optimum parameter values for the model circuit of FIG. 2) is shown in the Smith Chart plot of FIG. 7.

Figure 8:
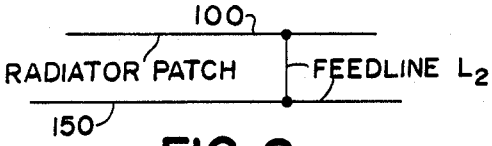
FIGS. 8 and 9 are schematic depictions of techniques for achieving the requisite series inductance in RF feed structure.
Figure 9:
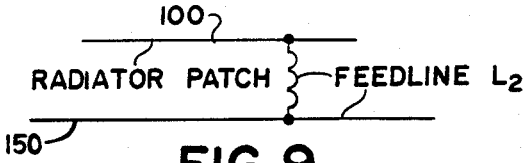

The third step of the optimized broadbanding procedure requires that a broadband antenna system network actually be constructed and built with the proper optimum values of L2 and C2. Thus, the "hardware" must be modified to implement the desired optimized circuit. In the exemplary embodiment, the inductance L2 comes from the feed post itself. For example, if a direct feed post connection is utilized to the patch as depicted in FIG. 8 a certain series inductance will result. If the determined optimal value is larger, the post may be reduced in cross-section (or coiled) as schematically depicted in FIG. 9. If the optimal value of L2 is less than the measured amount already present then the post diameter can be increased so as to decrease its parasitic inductance.

Figure 10A:
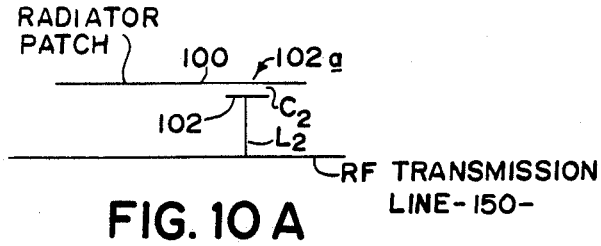

The requisite series capacitance C2 may be achieved as an integral part of the feed post assembly or other feeding structure, For example, as depicted in FIG. 10*a*, the radiator patch 100 may be fed via series capacitance C2 formed by a plate 102 spaced from the desired feedpoint 102*a* underneath the radiator patch 100. The desired series inductance L2 is achieved as depicted in FIG. 8 or 9 as the inherent parasitic series inductance of the feed post in this exemplary embodiment.

Figure 10B:
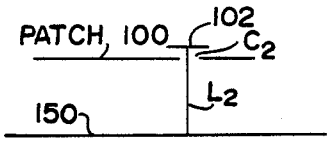
Figure 10C:
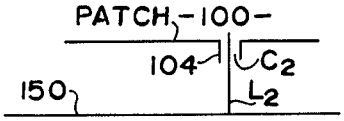
Figure 10D:
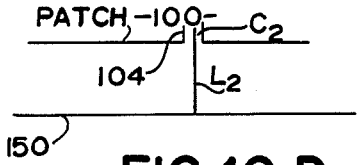

As depicted in FIG. 10*b*, the series capacitance C2 maybe achieved by suitably disposing plate 102 above the radiator patch 100 (with the connected feed post passing through a suitable aperture in the radiator 100). Other alternatives are shown in FIGS. 10*c* and 10*d* where the necessary series capacitance C2 is achieved by a cylindrical structure disposed below (10*c*) or above (FIG. 10*d*) patch 100 by using suitably cylindrical geometry including a cylindrical collar 104 suitable spaced from a cylindrical feed post L2. As will be appreciated, various combinations of all these techniques may be utilized (as may other conventional techniques for achieving desired capacitance/inductance parameters integrally associated with the feedline structure emanating from a standard r.f. transmission line 150).

The exemplary embodiment depicted at FIGS. 11*a*–11*d* and 12 comprises one element of a global antenna system as previously described. The actual measured input impedance is depicted in the Smith Chart plot of FIG. 13 for a single port of this dual-fed circularly polarized radiating antenna element. Resulting linear radiation patterns at 1227 MHz, 1381 MHz and 1575 MHz are shown respectively in FIGS. 14, 15 and 16. (One primary limitation in the overall beam width shown in FIGS. 14–16 is the "squinting" caused by feed pin radiation having a monopole pattern shape which is superimposed on the composite radiation pattern.) In addition, the quadrature hybrid circuit utilized did not have a bandwidth as large as the resulting optimized element and is therefore responsible for some deradation in the axial ratio of the patterns depicted at FIGS. 14–16.

In the exemplary embodiment, the desired 25% bandwidth encompassing L1 (1575 MHz) to L2 (1227 MHz) was achieved with approximately 1.8:1 VSWR or less. The 2:1 VSWR bandwidth achieved was greater than 28%. In addition, the radiation patterns achieved were quite reasonable over the entire required bandwidth. The following relevant parameter values were utilized for this exemplary embodiment:

Given $w_1 = 1.227$ GHz $(2\pi)$
$w_2 = 1.575$ GHz $(2\pi)$
$w_o = 1.401$ GHz $(2\pi)$
$g1 = 1.50$
$g2 = 0.455$
$g3 = 1.85$
$RIN = 50\Omega$ Calculated $C1 = 7.62$ pF
$L1 = 1.69$ nH
$L2 = 18.73$ nH
$C2 = 0.69$ pF
$R1 = 92.5\Omega$ The exemplary embodiment is designed for use in a hemispherical array of radiator elements with the underlying ground plane or reference surface 200 being conformed to a portion of a spherical surface (e.g., slightly more than one hemisphere). For ease of fabrication/maintenance, each radiator assembly includes its own separable ground plane or reference surface section 202 (also conformed to the spherical overall shape of the array reference dome 200). As depicted, it is typically secured in both mechanical and electrical contact to the overall spherical ground plane surface 200 with screws 204.

A doubly cladded printed circuit board layer 206 is physically and electrically bonded to spherical ground plane section 202. The top surface of the printed circuit board 206 includes a microstrip hybrid circuit 208 of conventional design and formed by conventional photochemical etching techniques. A conventional RF connector 210 is affixed so that its outer coaxial element is electrically connected to the underside of the conductively clad bottom surface of the, circuit board 206 (e.g., via solder and/or screws 212 and a dielectric washer 214). The center pin or input connector 216 of the coaxial RF connector 210 is affixed to the hybrid circuit 208 as depicted in FIG. 12 using conventional soldering techniques. Another port of the microstrip hybrid cirucit 208 is conventionally and resisitively terminated at 218 while the remaining two ports of the hybrid circuit 208 are electrically connected to the connector pins of respective feed assemblies 220 and 220*a*. As will be appreciated by those in the art, this insures that electrical RF signals fed to/from the radiator element 100 will have relative phase shifts of 90 electrical degrees at the design frequency of the hybrid circuit 208 (e.g., $w_o$) Since the element 100 is also fed at respective points spatially displaced by 90°, the result is circular or elliptical polarization.

In the exemplary embodiment. The microstrip radiator patch 100 (also spherically conformed so as to be concentric with the underlying spherical ground plane surface) is approximately one-half wavelength in diameter. It is conductively short-circuited at its centerpoint by a conductive standoff member 222 which is bolted to the ground plane structure 202 through an aperture in the printed circuit board 206 as depicted in FIG. 11*a*. The standoff 222 is dimensioned so as to maintain the radiator patch 100 at a distance above the ground plane surface 200 which is less than one-tenth wavelength. The result is an annu1ar one-fourth Wavelength radius resonant cavity as will be appreciated by those in the art.

Since the feed assemblies 220 and 220*a* are identical, only one of them is depicted in detail in FIGS. 11*c* and 11*d*. The main connector pin 250 has a threaded lower section on which a mating threaded connector is utilized to mechanically and electrically connect the lower end to the desired port of the microstrip hybrid circuit 208. As depicted, this connection is facilitated by the provision of-aperture 224 in the ground plane 202 and by a corresponding etched aperture in the lower cladded surface 207 of printed circuit board 206. The remaining lower portion of pin 250 can be seen to have a first diameter which is dimensioned so as to produce the desired and requisite series inductance L2 (e.g., a section approximately 0.48 inches long by 0.047 inches in distal end portion of post 250 is formed with a relatively larger diameter (e.g., 0.090 inch) so as to cooperate with a dielectric spacing cyclinder 260 (e.g., Teflon having 0.093 inch inside diameter and 0.156 inch outside diameter) and a short cylindrical conductive collar ("conductive cylindrical member") 270 (e.g., 0.185 inch thick with an inside diameter of 0.157 inch) so as to produce the requisite series capacitance C2. As depicted in the drawings, conductive collar 270 is simply screw connected (so as to achieve both mechanical and electrical connection) to the appropriate feedpoint location of the microstrip radiator patch 100. A threaded portion on the distal end of 250 cooperates with a washer and nut so as to hold the dielectric cylinder 260 in place.

The exemplary embodiment is a relatively "thick" microstrip radiator formed with discrete metallic components physically spaced with standoff structures or the like above an underlying reference surface and this invention is particularly suited for use with such embodiments. However, it also will be appreciated that similar design techniques could be employed for the type of microstrip antenna system formed by selective photo-chemical etching of a doubly cladded dielectric sheet structure. In this event, the needed series inductance could be achieved by an appropriately dimensioned terminal section of microstrip transmission line associated with each microstrip radiator element and an appropriately dimensioned series capacitance could also be associated integrally in the feed structure (e.g., by opposing closely-spaced sections of stripline).

While only a few exemplary embodiments of this invention have been described in detail, those skilled in the art will recognize that many variations and modifications may be made in this exemplary embodiment while yet retaining many of the novel features and advantages of this invention. Accordingly, all such modifications and variations are intended to be included within the scope of the appended claims.

What is claimed is:

1. A broadbanded microstrip antenna comprising:

a conductive reference surface;

a conductive RF radiator element of approximately circular shape having a diameter of approximately one-half wavelength at the mid-point of its usable frequency bandwidth;

a conductive standoff post physically and electrically connecting the center of said radiator element to the underlying reference surface and positioning said radiator element less that one-tenth wavelength thereabove;

an RF disposed below said radiator element;

a conductive RF feedline post connected to said RF input and extending, at least in part, upwardly towards said radiator element, a lower portion of said feedline post being dimensioned to provide series inductance L2; and an upper portion of said feedline post being spaced from the radiator conductor, the feedline post upper portion and the radiator conductor cooperating to establish an RF connection exhibiting a series capacitance C2, said inductance L2 and capacitance C2 being dimensioned to produce a 2:1 VSWR bandwidth of at least 25%.

2. A broadbanded microstrip antenna as in claim 1 wherein said L2 and C2 values are both optimally dimensioned to provide a usable bandwidth encompassing frequencies from 1227 MHz (L2) through 1575 MHz (L1).

3. A broadbanded microstrip antenna as in claim 1 which is adapted for circular or elliptical polarization by further comprising:

a second conductive RF feedline post connected to said RF input and extending, at least in part, upwardly.from said RF input and also having a lower portion dimensioned to provide inductance L2 and an upper portion spaced from said radiator conductor to establish an RF connection via a series capacitance C2 existing between said upper portion and said radiator conductor, said first and second capacitive couplings being connected to said radiator element at points which are spatially offset from one another by approximately 90°, and said RF input comprising a microstrip feedline/hybrid coupler disposed above said reference surface and providing an approximately 90° electrical phase shift between two separated points to which said first and second RF feedline posts are respectively connected.

4. A broadbanded microstrip antenna as in claim 3 wherein said radiator element includes at each coupling point a conductive cylindrical member connected to said radiator element, coaxial with the upper portion of the co-located RF feedline post and spaced therefrom by a dielectric cylinder.

5. A broadbanded microstrip antenna as in claim 1 wherein said radiator element includes a conductive cylindrical member connected thereto and coaxial with at least a portion of the RF feedline post and spaced therefrom by a dielectric cylinder.

6. A broadbanded microstrip antenna as in claim 5 wherein said RF feedline post includes an upper portion having a first diameter where it passes through said conductive cylindrical member to provide said series capacitance C2 and having a reduced diameter therebelow to provide said series inductance L2.

7. A broadbanded microstrip antenna as in claim 1 wherein said reference surface and said radiator element each comprise sections of a spherical surface.

8. A broadbanded microstrip antenna as in claim 1 wherein said feedline post has geometry and dimensions selected so as to provide an optimum series inductance L2.

9. A broadbanded microstrips antenna as in claim 1 wherein said series inductance L2 and series capacitance C2 are optimally dimensioned to produce a large VSWR bandwidth.

10. A broadbanded microstrip antenna as in claim 1 wherein the spacing between said feedline post upper portion and said radiator conductor is dimensioned so as to provide an optimum series capacitance C2 which resonates with said feedline post series inductance L2 at at least one frequency within an intended operating frequency range.

11. A broadbanded microstrips antenna as in claim 1 wherein said series inductance L2 and said series capacitance C2 are provided integrally to said feedline post and radiator element.

12. A broadbanded microstrip antenna as in claim 1 wherein said series inductance L and series capacitance C are optimally dimensioned to provide a large VSWR bandwidth.

13. A broadbanded microstrip antenna comprising:

a conductive reference surface;

a conductive RF radiator element having at least one resonant dimension and disposed less than one-tenth wavelength above said reference surface so as to define a resonant cavity therebetween and at least one radiating aperture between an outer edge of the radiator element and the underlying reference surface; and a conductive RF feedline capacitively coupled to a predetermined feedpoint on said radiator element with an integrally-defined series capacitance C and including an integrally-defined series inductance L, said capacitance C and inductance L being programmed to series-resonate at approximately the mid-band parallel resonant frequency of said radiator element, said integrally-defined capacitance C existing between juxtaposed portions of the feedline and RF radiator element.

14. A broadbanded microstrip antenna as in claim 13 wherein said feedline has geometry and dimensions selected so as to provide an optimum series inductance L.

15. A broadbanded microstrip antenna as in claim 13 wherein said feedline includes a vertically extending conductive post having a cylindrical shape and said integrally-defined capacitance C comprises:

a conductive collar affixed to said radiator therethrough aligned with a mated aperture in the radiator element at said predetermined feedpoint; and a cylindrical section of said feedline extending through said cylindrical passage and spaced therefrom by a predetermined dimension.

16. A broadbanded microstrips antenna as in claim 15 wherein a lower portion of said vertically extending conductive post has a diameter which is less than the diameter of the cylindrical section which extends through said cylindrical passage.

17. A broadbanded microstrip antenna comprising:

a conductive reference surface:

a conductive RF radiator element having at least one resonant dimension and disposed less than one-tenth wavelength above said reference surface so as to define a resonant cavity therebetween; and a conductive RF feedline structure spaced from a predetermined feedpoint on said radiator element, said conductive RF feedline structure having a geometry and having dimensions which provide a substantially optimum integral series inductance L, said feedline structure to feedpoint spacing being dimensioned to provide a substantially optimum series capacitance C, said inductance L and capacitance C together resonating at a desired operating frequency of said radiator element.

18. A method of broadbanding a microstrip antenna of the type including a conductive reference surface and a conductive RF radiator element having at least one resonant dimension and disposed less then one-tenth wavelength above said reference surface so as to define a resonant cavity therebetween and further including an RF feedline structure coupled to a predetermined feedpoint of said radiator element, said feedline structure having an integral series capacitance and inductance, said method including the steps of:

(1) modelling with a bandpass filter network model the integral series capacitance and inductance of said RF feedline structure to obtain optimized model parameters;

(2) deriving an optimum series inductance value L2 and an optimum series capacitance value C2 for said feedline structure from said optimized model parameters;

(3) providing said RF feedline structure dimensioned so as to exhibit approximately said derived optimum series inductance value L2; and (4) capacitively coupling said provided feedline structure to said conductive RF radiator element, including spacing said provided feedline structure a predetermined distance from the radiator element so as to provide a series capacitance therebetween of approximately said derived optimum series capacitance value C2.

* * * * *